United States Patent [19]

Loos et al.

[11] Patent Number: 5,074,211

[45] Date of Patent: Dec. 24, 1991

[54] WASHING-MEDIUM DISPENSER AND WASHING DEVICE

[75] Inventors: Gerhard Loos, Horrenberg; Nikolaus Spiegel, Walldorf, both of Fed. Rep. of Germany

[73] Assignee: Heidelberger Druckmaschinen AG, Heidelberg, Fed. Rep. of Germany

[21] Appl. No.: 496,532

[22] Filed: Mar. 20, 1990

[30] Foreign Application Priority Data

Mar. 20, 1989 [DE] Fed. Rep. of Germany ..... 3909115

[51] Int. Cl.[5] ..... B41F 35/00; B41L 41/00

[52] U.S. Cl. ..... 101/425; 15/256.51

[58] Field of Search ..... 101/425, 423; 15/256.51, 256.52, 256.53

[56] References Cited

U.S. PATENT DOCUMENTS

| | | | |
|---|---|---|---|
| 2,771,904 | 12/1952 | Sherman et al. | 137/454.2 |
| 3,309,993 | 3/1967 | Grembecki et al. | 101/425 |
| 3,355,324 | 11/1967 | Catzen | 101/423 X |
| 3,897,726 | 8/1975 | Tanghans | 101/425 |
| 3,983,813 | 10/1976 | Keuji Taui | 101/425 |
| 4,132,167 | 1/1979 | Ishii | 101/425 |
| 4,232,604 | 11/1980 | Waizmann | 101/425 |
| 4,344,361 | 8/1982 | MacPhee et al. | 101/425 |
| 4,480,548 | 11/1984 | Rebel et al. | 101/425 X R |
| 4,757,763 | 7/1988 | MacPhee et al. | 101/425 |
| 4,922,821 | 5/1990 | Nozaka et al. | 101/425 |
| 4,953,252 | 9/1990 | Akisawa | 101/425 X |
| 4,981,078 | 1/1991 | Dettinger et al. | 101/425 X |
| 4,986,182 | 1/1991 | Sawaguchi et al. | 101/425 X |
| 5,012,739 | 5/1991 | Loos et al. | 101/425 |

FOREIGN PATENT DOCUMENTS

| | | |
|---|---|---|
| 7009246 | 5/1972 | Fed. Rep. of Germany . |
| 2158185 | 9/1973 | Fed. Rep. of Germany . |
| 2900712 | 7/1980 | Fed. Rep. of Germany . |
| 2938671 | 3/1981 | Fed. Rep. of Germany . |
| 3810786 | 10/1988 | Fed. Rep. of Germany . |
| 3744800 | 6/1989 | Fed. Rep. of Germany . |
| 1575686 | 9/1980 | United Kingdom . |

OTHER PUBLICATIONS

Deppert et al. "Pneumatische Steuerungen" pp. 46 ∝ 55, Kamprath-Reihe Kurz und Bündig Technik, Vogel Verlag.

*Primary Examiner*—Edgar S. Burr
*Assistant Examiner*—Moshe I. Cohen
*Attorney, Agent, or Firm*—Herbert L. Lerner; Laurence A. Greenberg

[57] ABSTRACT

A washing-medium dispensing device for a washing device of a printing machine which cleans the outer cylindrical surface of rollers or cylinders includes a distributor line formed with a plurality of dispensing apertures extending over the length of the washing device, as washing-medium supply vessel being under atmospheric pressure and connected to the distributor line for feeding washing medium thereto, and a slider device for controlling a dispensing release of the dispensing apertures simultaneously; and a washing device including the dispensing device.

16 Claims, 6 Drawing Sheets

1
2
3
3'
3"
5
6
7
8
9
11
12
13
E
E
X
Y
SP

WASHING-MEDIUM DISPENSER AND WASHING DEVICE

The invention relates initially to a washing-medium dispensing device for a washing device on a printing machine, the washing device serving, for example, to clean the surface of a roller or a cylinder of the printing machine. A washing device of this general type serves for cleaning a rubber blanket cylinder, for example. The dispensing device for washing medium has a distribution line extending along the length of the washing device, and formed with several dispensing apertures.

The invention relates further to a washing device on a printing machine, which has a dispensing device for washing medium and cooperates with such a device, respectively. A washing device of this general type serves also for performing the aforementioned cleaning operations. The washing device has a washing-medium dispensing device, in order to dampen or saturate a washcloth or cleaning cloth with washing liquid. The washcloth is drawn or unwound from a supply reel in the washing device, and is wound on a soiled-cloth take-up reel also in the washing device. In this process, the washcloth is drawn over an actuable pressure applicator, for the purpose of pressing the washcloth against the cylinder and the roller, respectively, during the washing procedure, by means of the pressure applicator.

A washing-medium dispensing device of the general type described in the introduction hereto has become known heretofore, for example, from German Published Prosecuted Application (DE-OS) 14 36 535. This conventional dispensing device for washing medium includes a distributor line which extends along the length of a brush roller. The distributor line is connected to a pump, and the washing liquid is delivered by means of a mechanically actuated liquid injection pump. For this purpose, the washing liquid is injected into the distributor line and emerges initially therefrom into a channel surrounding the distributor line, from which it then runs by force of gravity through dispensing apertures onto the roller. A washing-medium dispensing device of this type has not yet been found to be satisfactory with respect to the metering precision thereof. This is especially true when such a dispensing device is used in connection with a washing device having a washcloth or cleaning cloth, as mentioned hereinbefore. Because the washing liquid must be delivered, furthermore, by means of an injection pump, the reliability is also not yet regarded as optimal either.

With regard to the washing device, it has also become known in the prior state of the art (cf. German Patent 29 38 671) to deliver the washing liquid in a rising direction to the washcloth via spray nozzles. However, not only does such a procedure aggravate the limitation as to quantity, but the rebound action furthermore results in an undesired scattering effect due to the deflection of the washing liquid which is, moreover, delivered at the underside of the washcloth. In addition, the feed system to the dispensing apertures proves to be costly, in this regard, due to the required pressure source, namely a pump.

With regard to the state of the art described hereinabove, it is an object of the invention to provide a washing-medium dispensing device for a washing device on a printing machine which affords high metering precision for the simplest possible construction.

It is another object of the invention to provide a washing device which is simplified with regard to construction and coordination technology, and which is optimized with regard to the output function thereof.

With the foregoing and other objects in view, there is provided, in accordance with the invention, a washing-medium dispensing device for a washing device of a printing machine which cleans the outer cylindrical surface of rollers or cylinders, comprising a distributor line formed with a plurality of dispensing apertures extending over the length of the washing device, a washing-medium supply vessel being under atmospheric pressure and connected to the distributor line for feeding washing medium thereto, and slider means for controlling a dispensing release of the dispensing apertures simultaneously.

In accordance with another aspect of the invention, there is provided a washing device of a printing machine for cleaning the outer cylindrical surface of rollers or cylinders, comprising a washcloth supply reel and a soiled washcloth reel soakable with washing liquid, means for withdrawing the washcloth from the supply reel by winding it on the soiled washcloth reel via an actuable pressure applicator, so that, during a washing operation, the pressure applicator presses the washcloth, together with a washing-liquid dispensing device, against a roller or cylinder, the dispensing device comprising a distributor line formed with a plurality of dispensing apertures extending over the length of the washing device, a washing-liquid supply vessel under atmospheric pressure connected to the distributor line for feeding washing liquid thereto, and slider means for controlling a dispensing release of the dispensing apertures simultaneously, an upwardly exposed section of washcloth disposed upstream of the pressure applicator in transport direction of the washcloth being located beneath the washing-liquid dispensing device.

In accordance with the invention, the distributor line of the dispensing device for washing liquid is fed from a supply of washing liquid held at atmospheric pressure, and a release of dispensed washing liquid from the dispensing apertures occurs simultaneously under control by a slider. By means of the slider control, very small quantities of washing liquid present under atmospheric pressure at the dispensing apertures can be metered out with high precision. The washing liquid is delivered simultaneously from the dispensing apertures along the length of the washing device with high metering precision.

The dispensing device for washing liquid is considerably simplified with respect to construction, because an excess pressure system for the washing liquid has been eliminated. As a result of the slider-controlled dispensing release and because the supply of washing liquid is held under atmospheric pressure, the washing liquid can be applied to a washcloth or a brush roller in a targeted manner, and in gentle jets, without the need for a costly collecting channel underneath the distributor. The actuation of the slider requires considerably less energy, and can therefore be managed more reliably than subjecting the washing liquid to pressure in order to achieve a spray effect.

In accordance with a further feature of the invention, a displaceably positioned sealing element engages the underside of each dispensing aperture of the distributor for affecting simultaneous dispensing. The sealing element affords delivery with a minimum of subsequent dripping and thereby exact metering of the washing liquid. The sealing elements are accommodated in a slider, for the simultaneous slider-controlled dispensing release discussed hereinbefore. The sealing elements can be actuated simultaneously by means of the slider.

In a first embodiment the slider has a releasing aperture, respectively, laterally to the sealing elements or components. A dispensing aperture and a releasing aperture can be formed so as to be very close to one another, in which case a movement from a closed position to an open position and vice-versa is possible by means of a very short stroke of the slider.

It is further proposed, in accordance with the invention, that the slider be constructed so as to extend longitudinally and in parallel with the distributor line.

In accordance with an added feature of the invention, the slider is actuable pneumatically against the bias of a restoring or reset spring. Alternatively, mechanical or hydraulic actuation can be provided.

It is essential that the shortest possible stroke times be achieved, and in an actual embodiment, this is achieved by means of a pneumatic actuation. In this regard, the reset spring simplifies the corresponding mechanism, so that something of the nature of a double-action piston, i.e., a piston which is acted upon on both sides thereof is unnecessary.

With regard to sealing technology, and especially with respect to the prevention of washing liquid drips, in accordance with an additional feature of the invention, an intermediate sealing layer is disposed between the distributor line and the dispensing apertures, respectively, on the one hand, and the slider, on the other hand. The intermediate sealing layer is provided with apertures which are congruent to the dispensing apertures. If a sealing component or sealing components are constructed with a given elasticity, a non-elastic intermediate sealing layer is selected. On the other hand, the intermediate sealing layer is formed of an elastically resilient material if the sealing elements are largely of non-elastic construction.

In accordance with yet another feature of the invention, the sealing element is positioned in a take-up cavity of the slider and is biased against the dispensing aperture by means of a spring braced against the floor of the take-up cavity. The sealing element, and the region of the intermediate sealing layer cooperating therewith prevent any leakage. The spring optimizes the corresponding sealing effect. If no intermediate sealing layer is provided as a separate structural component, it is preferable that the underside of the distributor line and also the other guiding surfaces for the slider be treated by mass anodizing and impregnated with PTFE (Polytetrafluoroethylene).

In accordance with yet a further feature of the invention, the sealing component is formed with an outlet opening which is an extension of the dispensing aperture of the distributor line when in the dispensing position. By this means, the washing liquid is dispensed right through the sealing component.

In accordance with yet an added feature of the invention, the releasing apertures provided in the slider are larger in cross-section or diameter than that of the aforementioned outlet opening. Consequently, a tolerance-related mismatch, for example, cannot lead to a restriction of the desired basic cross-section.

In accordance with an alternate feature of the invention, the sealing component is formed with an orifice for the dispensing aperture, and the orifice cross-section corresponds approximately to the cross-section of the dispensing aperture. The orifice can be drawn so far forward that it projects downwardly beyond the slider. Furthermore, the sealing component can be constructed in such a way that it partly covers the release aperture, at the edge. In the case of a sealing component with an outlet opening, an alternative is also provided, in accordance with the invention, whereby the spring which is supported in the take-up cavity and which biases the sealing component against the distributor line, is disposed, when in the "locked" position, approximately co-axially to the dispensing aperture, while it is lateral to the outlet opening.

In accordance with an additional feature of the invention, the outlet opening is formed in the sealing component, and the spring is disposed concentrically to the outlet opening. The recess required for the spring can be produced by suitably turning down or hollowing out the take-up cavity or recess.

In accordance with yet another feature of the invention, the sealing component is formed with at least one bulge or sealing pad cooperating with an intermediate sealing layer, if present. A sealing pad of this sort is preferably of button-like construction, with a considerably smaller diameter than the width of the slider. The sealing pad preferably constructed so as to be disposed in a double arrangement in the direction of the stroke, downstream and upstream of the outlet opening, is advantageous with regard to the aforementioned danger of the dripping of washing liquid. In this regard, it is also preferred that, in the "locked" position, one sealing bulge itself forms a locking or closure element which closes the dispensing aperture.

With respect to the washing device of the invention, it is noted that a section of the washcloth located upstream of the pressure applicator, in the direction of transport of the washcloth, and upwardly exposed, is disposed underneath the washing-medium dispensing device which extends along the elongated side of the washing device. If, as preferred within the scope of the invention, the washing device is constructed as an insertion component, which can be disengaged from the printing machine rather simply in order, for example, to exchange the washcloth, it is advantageous for the washing-medium dispensing device to be fixed in position on the machine. Supplying the washing liquid from above considerably facilitates the guidance of the washing liquid to the washcloth and the exact metering of the washing liquid onto the washcloth. With respect to the washing device, it is more favorable both for connection techniques and maintenance reasons to dispense with the cost-intensive spraying system. The utilization of the supplied washing liquid becomes practically loss-free. Accordingly, the device works extremely economically, particularly because special conveying means such as pumps, and the like are unnecessary due to the selected position of the dispensing device relative to the section of washcloth.

With regard to a rapid and balanced distribution, in accordance with yet an added feature of the invention, a distributor lip is provided which is engageable with the washcloth at a location downstream from the dispensing device in the direction in which the washing cloth is transported forwards. Provision can basically be made by this means for the washing liquid to run out directly at the distributor lip. In accordance with a concomitant feature of the invention, however, means are provided for feeding the washing liquid to the washcloth at a location downstream from the distributor lip, and for the washcloth to be guided on an inclined path in a wetting region of the upwards exposed section thereof. This results in a flowing stream of the metered quantity of liquid on the sloping or inclined section of washcloth, with a distribution trend in the direction of the lip. Washing liquid briefly accumulating thereat is distributed in both directions longitudinally with respect to the washing device. It is further noted that any features of the dispensing devices described hereinbefore may be implemented additionally in the washing device either individually or in their entirety.

Other features which are considered as characteristic for the invention are set forth in the appended claims.

Although the invention is illustrated and described herein as embodied in a washing-medium dispenser and washing device, it is nevertheless not intended to be limited to the details shown, since various modifications and structural changes may be made therein without departing from the spirit of the invention and within the scope and range of equivalents of the claims.

The construction and method of operation of the invention however, together with additional objects and advantages thereof will be best understood from the following description of specific embodiments when read in connection with the accompanying drawings, in which.

Figure 1:
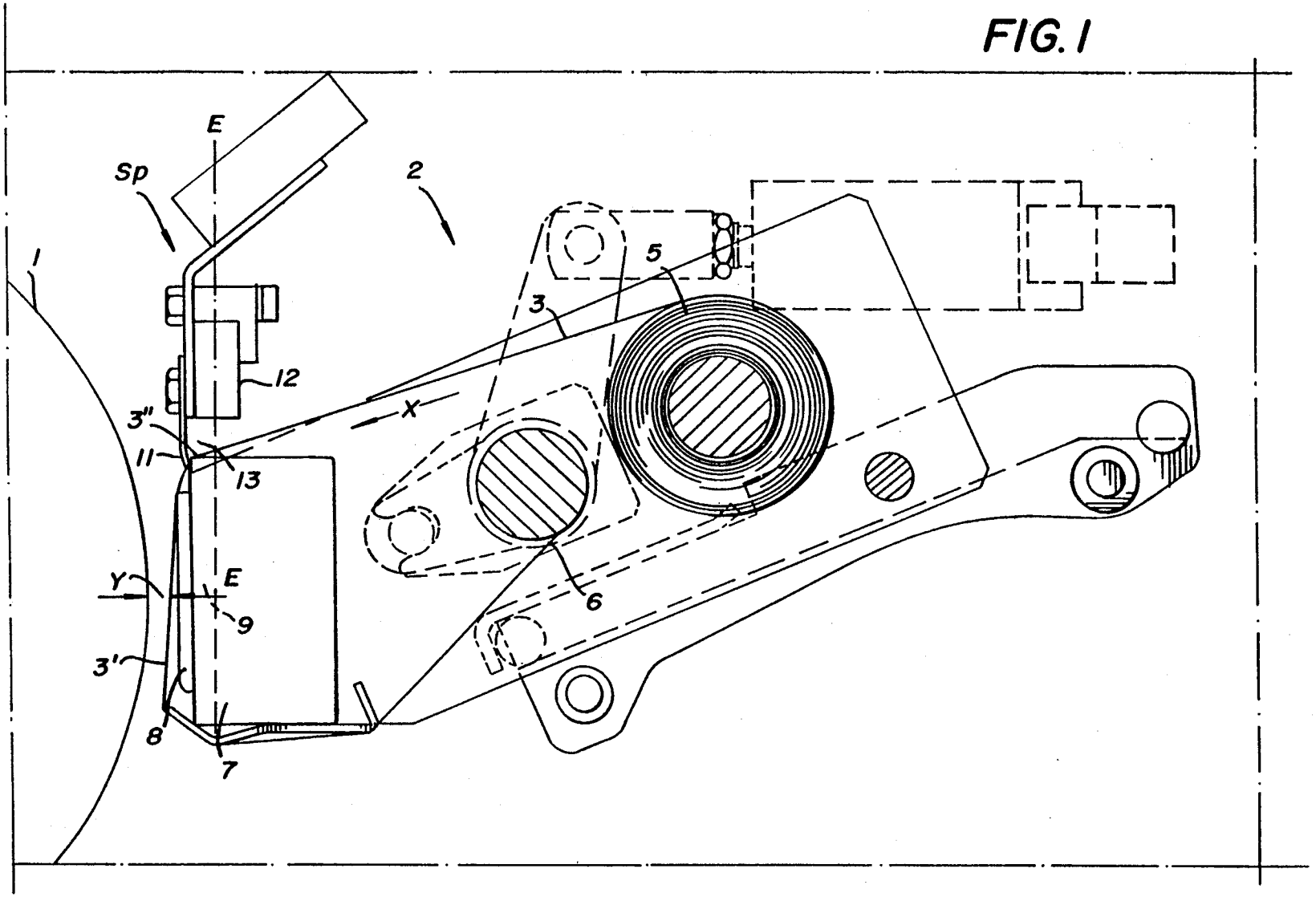
FIG. 1 is a side elevational view of a washing device for a printing machine according to the invention having a pressure applicator which has not yet been actuated.

Referring now to the drawing and, first particularly to FIG. 1 thereof, a washing device 2 is shown in the vicinity of a diagrammatically illustrated rubber blanket cylinder 1 of an offset printing machine. The washing device 2 is provided with a washcloth 3 which can be wetted with a washing medium 4 of suitable conventional type.

The washcloth 3 is advanced stepwise in the direction of an arrow x, i.e. in a direction towards the rubber blanket cylinder 1. The washcloth 3 issues from a supply reel 5 and is fed back onto a soiled-cloth reel 6. Both reels are mounted horizontally, as is also the rubber blanket cylinder 1. The soiled-cloth reel 6 is closer than the supply reel 5 to the rubber blanket cylinder 1.

In the vicinity of a loop or return which is located close to the outer cylindrical surface of the rubber blanket cylinder 1, the washcloth 3 is drawn over a pressure applicator 7. A press-on zone is formed by a rail or strip-like cushion 8. By applying an auxiliary medium such as pressurized air to a pressure chamber 9 behind the press-on zone, a vertically guided contact section 3' of the washcloth 3 comes into tangential contact with the rubber blanket cylinder 1, so that the intended washing effect takes place. When the pressure application ends, the contact section 3' of the washcloth 3 moves back again from the rubber blanket cylinder 1 due to the action of a resetting force inherent to the cushion 8 so that a gap y is formed between the washcloth 3 and the rubber blanket cylinder 1. The gap y has a width of several mm.

After each washing procedure, the washcloth 3 is transported a given distance farther, for example, under program control.

A dispensing device Sp fixed to the printing machine performs a metered feeding of the washing medium 4. The dispensing device Sp extends transversely over the entire width of the washcloth 3. It lies above an upwardly exposed section of washcloth 3''. This section of the washcloth 3'' extends at a marked inclination, with respect to a horizontal plane, towards the rubber blanket cylinder 1 as shown in FIG. 1. It is also apparent from FIG. 1 that the underside of the dispensing device Sp for the washing medium in which there are formed release apertures 10 for the washing liquid, as shown for example in FIG. 3, terminates with a clear spacing from the washcloth section 3''.

A distributor lip 11 is assigned to the washing-medium dispensing device Sp. The distributor lip 11 is firmly mounted on a strip-like distributor block 12. The cross section of the distributor lip 11 formed of flexible and elastic material, respectively, extends primarily in vertical direction but, at a downwardly extended end thereof it assumes a concave curvature with respect to the washcloth section 3'' in the illustrated embodiment of FIG. 1. The lower end of the curved section of the distributor lip 11 is in contact with the washcloth section 3''. The distributor lip 11, which is seatable on the washcloth section 3'', extends, as viewed in the forward travel or transport direction x of the washcloth 3, behind the washing-medium dispensing device Sp, transversely over the width of the washcloth 3.

With regard to the distributor lip 11, it is essential that this be set up as a squeegee or wiper.

Because the release apertures 10 extend along a central vertical and longitudinal plane E—E of the distributor or block 12, the washing liquid 4 (FIG. 2) consequently flows into the dispensing device 12 at a spaced distance from the distributor lip 11, so that, as viewed in cross section in FIG. 1, an acute-angled distribution region 13 is formed between the distributor lip 11 and the inclined section 3'' of the washcloth, as a wetting region. The distance between the distributor lip 11 and the respective axes of the release apertures 10, which are disposed in the plane E—E, preferably is several mm, about 10 mm at a maximum. The latter distance is set so that, on the one hand, an adequately large washcloth section 3'' is provided to soak up the washing liquid 4 and, on the other hand, excess washing liquid 4 which has not immediately been soaked up flows to the distributor lip 11 for distribution in the direction of the width and length, respectively, of the washcloth 3.

A supply vessel or tank 16 disposed above the dispensing device Sp, is connected via a feedpipe 15 to one end of a distributor line 20 (FIG. 2), and a venting tube 19, which is open at an upper end thereof, is connected at its lower end to the other end of the distributor line 20. The washing liquid 4 thereby can always be available, without any hindrance, at the dispensing apertures 14 of the washing- liquid dispensing device Sp.

Figure 2:
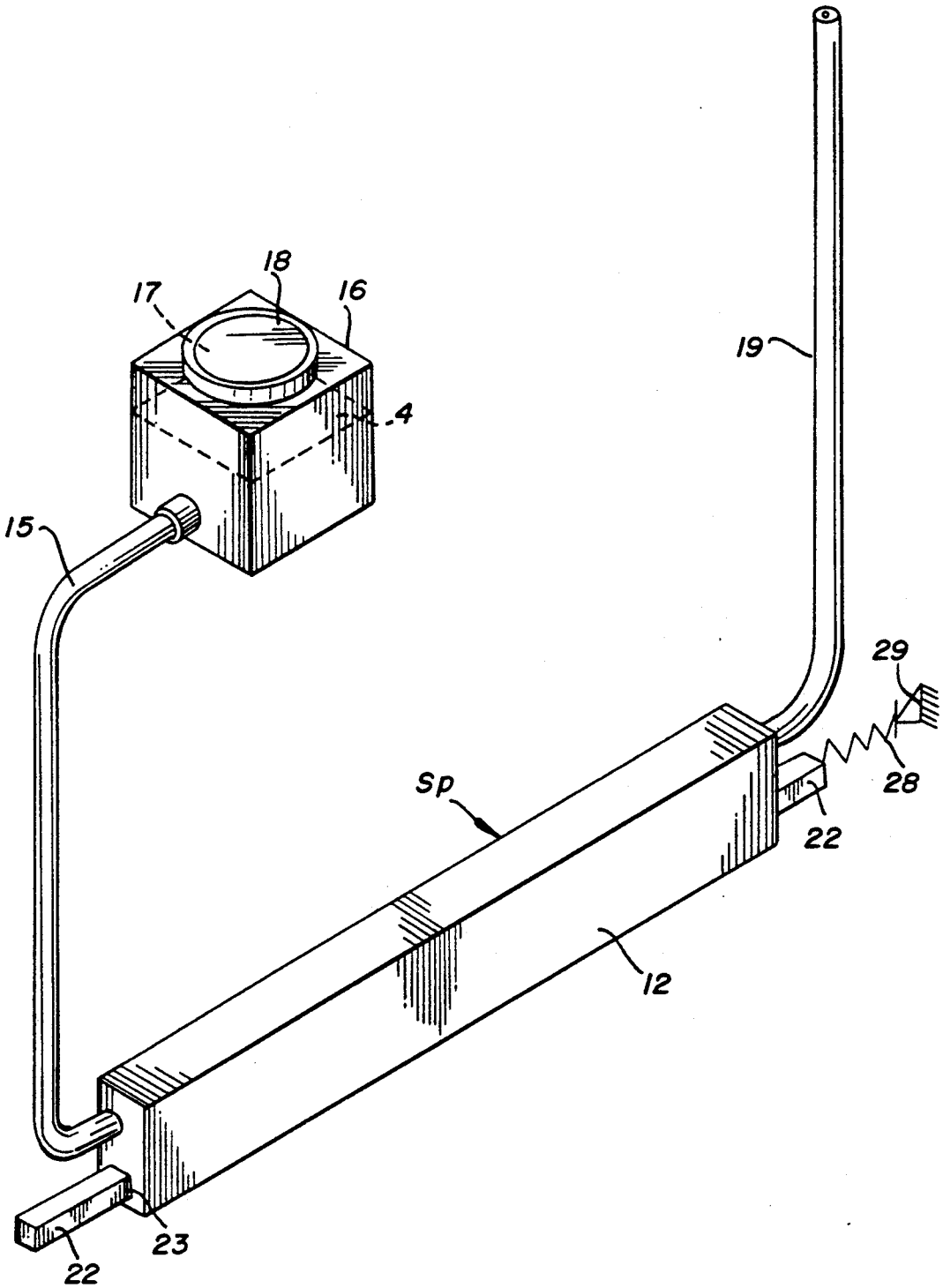
FIG. 2 is a detailed perspective view of a washing-medium dispenser with a supply vessel according to the invention.

With reference to FIG. 2, it is noted that the feedpipe 15 is located at the left-hand side of the figure.

The feedpipe 15 extends from an end face of the beam-like distributor block 12 and is connected thereabove via an elbow to the supply vessel 16. This supply vessel 16 is formed with a refill opening 17, which is sealable with a cover 18 and is additionally provided with a non-illustrated conventional air compensation opening or pressure relief vent. Such a pressure relief vent can be formed in the cover 18.

The venting tube 19 extending upwardly and open at the upper end thereof starts from the other face of the distributor block 12. The open end of the venting tube 19 is located above the supply vessel 16, or at least above a maximum surface level of the washing liquid 4.

The distributor line 20 provides a flow connection between the two tubes, namely the feedpipe 15 and the venting tube 19, and extends from end face to end face along the beam-like distributor block 12. The downwardly directed dispensing apertures 14 extend therefrom in the form of vertical bores.

The supply vessel 16 of washing medium, i.e., washing liquid 4 under atmospheric pressure with which the washing-liquid dispensing device Sp communicates, is released under the control of a slider. This form of mechanical actuation is affected by a pneumatic cylinder 2 (FIG. 3) having a one-sided action and cooperating with a slider 22. A guide 23 for the slider 22 lies underneath the distributor 20. The guide 23 is formed by the inner surface of a downwardly open C-profile of the distributor block 12. The distributor 20 is located in a central section of a thick-walled side of the C-profile, while the C-legs of thinner cross section have angular ends directed towards one another and formed with upper inner surfaces 24 so as to provide a support for the slider 22 of rectangular or square cross-section. The guide 23 which, for this purpose, is form-locking or positively secured, prevents rotational or torsional dislocations of the slider 22.

The slider 2 further has sealing components 25 which seal the dispensing apertures 14 in the closed position. These sealing components 25 have a greater diameter than the inner diameter of the dispensing apertures 14. The sealing components 25 are formed of material having favorable sealing properties. The sliding properties of the sealing components 25 and of the inner-surface walls of the C-profile are also of great importance. The sealing components 25 are located in the slider 22 which extends parallel to the distributor line 20. The slider 22 is formed with respective take-up recesses or cavities 26 into which the respective sealing components 25 are guided. In the embodiment according to FIG. 3, the take-up cavities 26 are formed as blind bores. These blind bores 26 and, accordingly, also the sealing components 25 located therein are disposed closely adjacent to the release apertures 10 formed in appropriate number in the slider 22. In order to increase the contact pressure of the sealing components 25, the latter are spring-loaded in a direction towards the dispensing apertures 14. In order to achieve favorable sliding properties, the inner surfaces of the C-profile can for example, be treated by mass anodic oxidation (anodizing) and a pretensioning of the sealing components is achieved in the illustrated embodiment of FIG. 3 by a spring 27, which is supported on or braced against the bottom of the take-up cavity 26.

Figure 3:
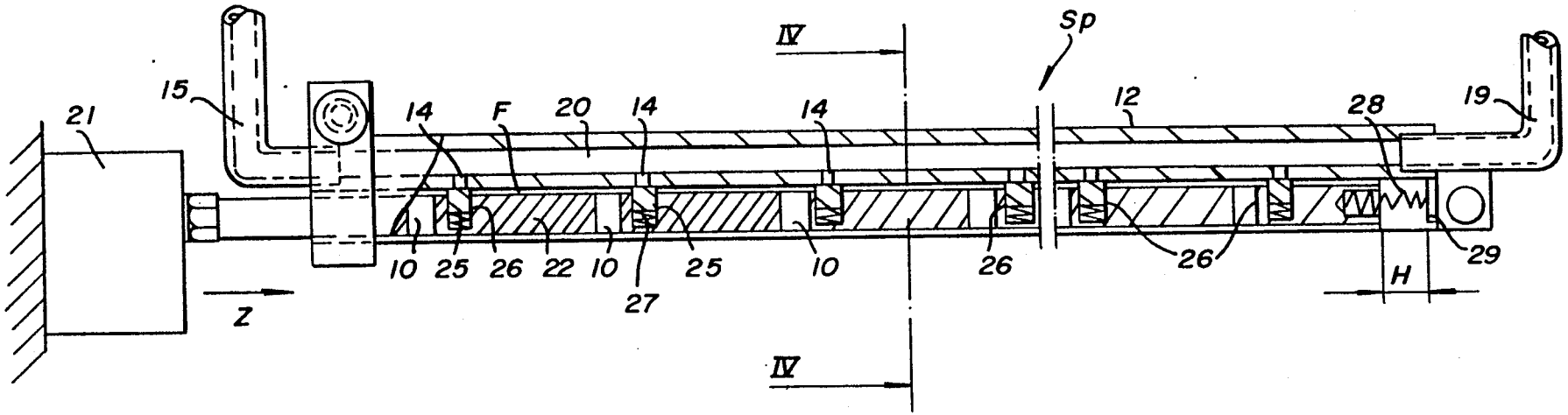
FIG. 3 is a fragmentary vertical sectional view of FIG. 2, showing sealing components thereof in closed position.

The sealing components 25 project beyond the upper side of the slider 22, as shown in FIG. 3.

The closed position of the pneumatically displaceable slider 22 represented in FIG. 3 is maintained by means of a reset spring 28 which has a spring force which can be overcome by the pneumatic cylinder 21, i.e. by the non-illustrated piston thereof. One end of the reset spring 28 is braced securely in place on the distributor block 12 and, more exactly, on a transverse wall 29 of a holder for the distributor block 12. The other end of the reset spring 28 acts against the corresponding end face of the slider 22, which takes up the reset spring 28 thereat in a spring chamber formed therefore.

When the slider 22 is actuated in the direction of the arrow z (FIG. 3), an extremely short stroke H, defined by a buffer or stop limit, is traversed in order to reach an open position. When all of the dispensing apertures 14 are released simultaneously, the release apertures 10 located in the slider 22 are in a co-axial position with respect to the dispensing apertures 14. The washing liquid 4, which is permanently located at the dispensing apertures 14, is distributed via the release apertures 10 due to geodetic pressure, e.g. gravity flow. The washing liquid 4 runs into the distributor zone 13, in which a well-balanced fine distribution occurs, due also to cooperation with the distributor lip 11. The open position or setting may be terminated in an equally very short manner by removing the working pressure from the pneumatic cylinder. The reset spring 28 snaps the slider 22 spontaneously back into its closed position.

A buffer or stop limit in the direction of the arrow z is affected when the free end of the slider 22 at the right-hand side of FIG. 3 comes into contact with the transverse wall 29 which, simultaneously, forms a counter-bearing for the reset spring 28.

Figure 4:
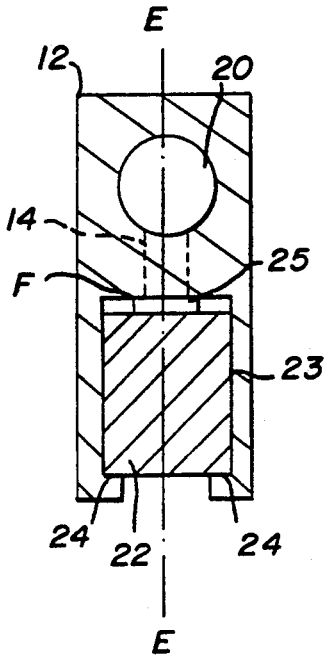
FIG. 4 is a cross-sectional view of FIG. 3 taken along the line IV—IV in the direction of the arrows.
Figure 5:
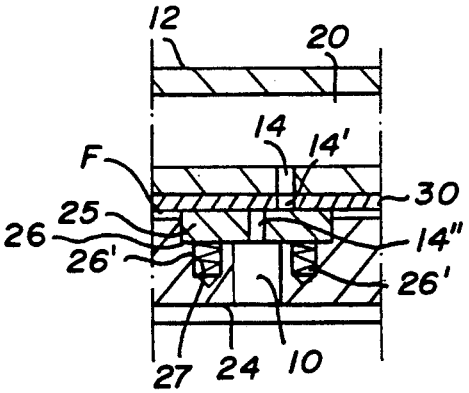
FIG. 5 is an enlarged fragmentary view of FIG. 3 with an alternative embodiment of the sealing component of the washing-medium dispenser.

A gap F between the underside of the thicker-walled central section of the C-profile and the corresponding upper side of the slider 22, as shown more clearly in FIGS. 4 and 5, is provided with an intermediate sealing layer 30 according to the embodiment of FIG. 5. This is a narrow strip formed of rubber or flexible plastic material which is secured to the distributor line 12. If the sealing components 25 are formed of rubber or of a flexible plastic material, which are possible alternatives, it is necessary for the intermediate sealing layer 30 to be formed of a relatively hard material. In each case, it is essential that a coefficient of friction which is as small as possible be attained between the intermediate sealing layer 30 and the upper side of the slider 22.

The embodiments of the sealing components 25 according to FIGS. 5 to 10 differ from the embodiment of the sealing components according to FIG. 3 in that the washing liquid 4 discharges through an outlet opening 14'' and 14''', respectively, formed in the sealing component 25. Thus, in the open position, the outlet openings 14'' and 14''', respectively, which have an appropriate cross section adjoin or connect with the dispensing aperture 14 and, if necessarily or desirably provided, the opening 14' in the intermediate sealing layer 30.

As can further be seen from FIG. 5, the release aperture 10 of the slider 22 is coaxially connected with the outlet opening 14''. The underside of the sealing component 25 is subjected to a loading or pre-compression by one or more springs 27, which press the sealing component 25 in a direction towards the gap F or the intermediate sealing layer 30. To receive the springs 27, take-up cavities 26' are also provided thereat in the form of blind bores. The actual take-up cavity 26 takes into account the shape of the sealing component 25. The latter also protrudes, in this case, slightly beyond the upper side of the slider 22.

Figure 6:
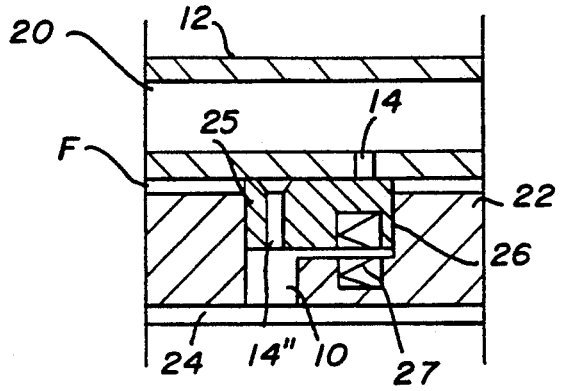
FIG. 6 is a view like that of FIG. 5 representing a further alternative embodiment of the sealing component.
Figure 7:
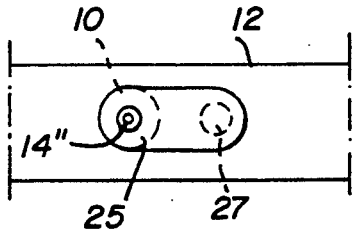
FIG. 7 is a top plan view of FIG. 6 showing a slider with the sealing component.

With the embodiment according to FIGS. 5, 6 and 7, the sealing component 25 is constructed as an oval element. It is formed of an elastic synthetic material with a low coefficient of friction. In the closed position represented in FIG. 6, the spring 27 is located somewhat concentrically to the dispensing aperture 14. The outlet opening 14'' is formed in the sealing component 25 and is located laterally to the spring 27. The outlet opening 14'' terminates in a release aperture 10 having a greater cross section.

Figure 8:
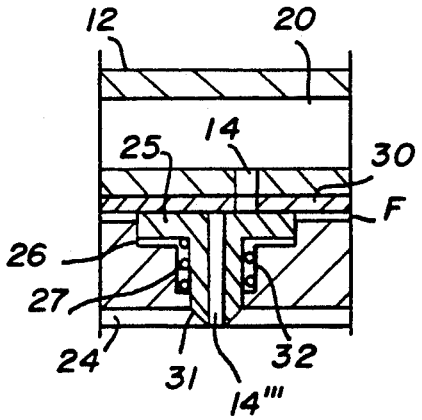
FIG. 8 is another view like that of FIG. 5 with yet another alternative embodiment of the sealing component namely, an embodiment formed with a downwardly directed port or aperture.
Figure 9:
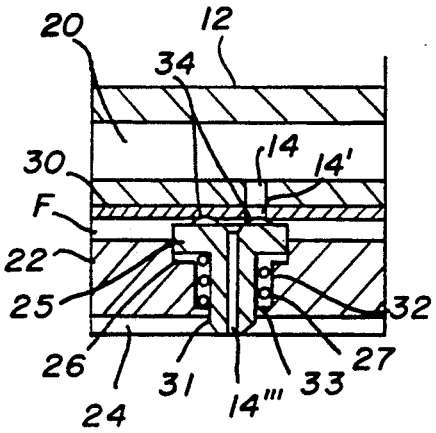
FIG. 9 is a view like that of FIG. 8 showing yet a further embodiment of the sealing component according to FIG. 8.

In the embodiment according to FIGS. 8 and 9, the sealing component 25, which is formed from an annular washer-like base and a stub or connection piece 31 molded thereto, the stub 31 being downwardly directed and completely passing through the slider 22, has an outlet opening 14''' with substantially the same inner or flow cross-section as that of the dispensing aperture 14.

In the last-mentioned embodiment, the spring 27 is disposed concentrically to the outlet opening 14''' and surrounding the stub or connecting piece 31. The take-up bore for the connecting piece 31 in the slider 22 is widened by turning in the upper region thereof so as to form a corresponding spring chamber 32. The lower section of the take-up bore, having a smaller inner diameter, forms a shoulder 33. A lower final coil of the spring 27 is braced against or supported on this shoulder 33, while the uppermost coil acts against the underside of the annular washer-like base. If it is necessary to secure the sealing component 25 against rotation relative to the slider 22, it can be accomplished, as described further hereinbelow, by appropriate molding technology. A slight axial play exists between the underside of the annular washer-like base of the sealing component 25 and the stepped upper side of the take-up cavity 26. This can also be provided in the embodiments according to FIGS. 5 and 6.

Figure 10:
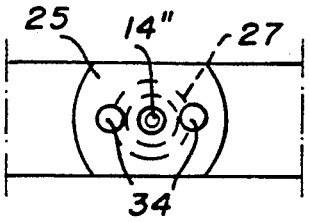
FIG. 10 is a fragmentary top plan view of FIG. 9, showing the slider with the sealing component.

In the embodiment according to FIGS. 9 and 10, the sealing component 25 has two sealing burls or knobs 34 on the upper side of the annular washer-like base of the sealing component 25. These are formed as buttons and are spaced from the outlet openings 14''. Furthermore, the sealing knobs 34 are formed with a diameter which is considerably smaller than the width of the slider 22. In the closed state, as represented in FIG. 9, one sealing knob 34 directly forms the closure for the dispensing aperture 14 or the opening 14'. To prevent sealing knobs 34 from becoming twisted or turned relative to the slider 22, the sealing component 25 is formed with mutually opposing flats, each of which is braced against a respective C-leg of thinner cross-section of the distributor block 12. A In the embodiment according to FIGS. 8 to 10, an improved return suction effect is produced, so that any drop of the washing medium which might be formed at the outlet opening 14''' is reduced in size upon closing.

The foregoing is a description corresponding in substance to German Application P 39 09 115.5, dated Mar. 20, 1989, the International priority of which is being claimed for the instant application, and which is hereby made part of this application. Any material discrepancies between the foregoing specification and the aforementioned corresponding German application are to be resolved in favor of the latter.

We claim;

1. Washing-medium dispensing device for a washing device of a printing machine which cleans the outer cylindrical surface of rollers or cylinders, comprising a washing device, a distributor line formed with a plurality of dispensing apertures extending over the length of the washing device, a washing-medium supply vessel, means maintaining washing medium in said supply vessel under atmospheric pressure and connected to said distributor line for feeding washing medium thereto, and slider means for controlling a dispensing release of said dispensing apertures simultaneously.

2. Dispensing device according to claim 1, including respective sealing components movable into contact from below with said dispensing apertures.

3. Dispensing device according to claim 2, wherein said slider means comprise a slider, and wherein said sealing components are mounted on said slider so as to be actuable in common thereby, said slider being formed with respective releasing apertures disposed laterally to said sealing components.

4. Dispensing device according to claim 1, wherein said slider means comprise a slider having an elongated construction and extending parallel to said distributor line.

5. Dispensing device according to claim 1, wherein said slider means comprise a slider pneumatically actuable so as to move in a given direction against a restoring force of a spring.

6. Dispensing device according to claim 1, wherein said slider means comprise a slider, and including an intermediate elastic sealing layer disposed between said distributor line and said slider, at least in vicinity of said dispensing apertures, said sealing layer being formed with perforations.

7. Dispensing device according to claim 2, wherein said sealing components, respectively, are received in take-up cavities formed in said slider means, and including respective springs received in said take-up cavities and braced against the bottom of said take-up cavities for biasing said sealing components against said dispensing apertures, respectively.

8. Dispensing device according to claim 2, wherein said sealing components, respectively, are formed with an outlet opening aligned, in an actuating condition, with a respective dispensing aperture.

9. Dispensing device according to claim 3, wherein said sealing components, respectively, are formed with an outlet opening alignable, in an actuating condition, with a respective dispensing aperture, said releasing apertures, respectively, having a greater diameter than that of the outlet openings.

10. Dispensing device according to claim 8, wherein said outlet openings and said dispensing apertures have substantially like cross sections.

11. Dispensing device according to claim 2, wherein said sealing components, respectively, are formed with an outlet opening and are received in take-up cavities formed in said slider means, and including respective springs engaging said sealing components for biasing said sealing components against said dispensing apertures, respectively; said springs in a closed position of the dispensing apertures, being disposed substantially coaxially thereto and laterally offset from the respective outlet openings.

12. Dispensing device according to claim 2, wherein said sealing components, respectively, are formed with an outlet opening and are received in take-up cavities formed in said slider means, and including respective springs engaging said sealing components for biasing said sealing components against said dispensing apertures, respectively, said springs being disposed concentrically with said outlet openings, respectively.

13. Dispensing device according to claim 6, including respective sealing components mounted on said slider means, said sealing components having a respective surface spaced from and facing towards said intermediate elastic sealing layer, said surface of said sealing components, respectively, being formed with at least one bulge cooperating with said intermediate elastic sealing layer for closing the respective dispensing apertures.

14. Washing device of a printing machine for cleaning the outer cylindrical surface of rollers or cylinders, comprising a washcloth mounted at one end on a washcloth supply reel and a second end mounted on a soiled washcloth reel, said washcloth being soakable with washing liquid, means for withdrawing the washcloth from said supply reel by winding it on said soiled washcloth reel via an actuable pressure applicator, so that, during a washing operation, said pressure applicator presses the washcloth, against a roller or cylinder, and a washing-liquid dispensing device comprising a distributor line formed with a plurality of dispensing apertures extending over the length of the washing device washing-liquid supply vessel, means maintaining washing liquid in said supply vessel under atmospheric pressure and connected to said distributor line for feeding washing liquid thereto, and slider means for controlling a dispensing release of washing liquid through said dispensing apertures simultaneously, an upwardly exposed section of washcloth disposed upstream of the pressure applicator in transport direction of the washcloth being located beneath said washing-liquid dispensing device.

15. Washing device according to claim 14, including a distributor lip engageable with the washcloth at a location downstream from said dispensing device in said transport direction of the washcloth.

16. Washing device according to claim 15, including means for feeding the washing liquid to the washcloth at a spaced distance from said distributor lip, and means for guiding the washcloth on an inclined path in a wetting region of the upwardly exposed section thereof.

* * * * *